US011419472B2

(12) United States Patent
Libman et al.

(10) Patent No.: US 11,419,472 B2
(45) Date of Patent: Aug. 23, 2022

(54) CLEANING IMPLEMENT

(71) Applicant: The Libman Company, Arcola, IL (US)

(72) Inventors: Aaron Libman, Champaign, IL (US); Robert Libman, Arcola, IL (US); Roberto Pellacini, Torrechiara Langhirano (IT)

(73) Assignee: The Libman Company, Arcola, IL (US)

( * ) Notice: Subject to any disclaimer, the term of this patent is extended or adjusted under 35 U.S.C. 154(b) by 202 days.

(21) Appl. No.: 16/818,658

(22) Filed: Mar. 13, 2020

(65) Prior Publication Data

US 2021/0282618 A1 Sep. 16, 2021

(51) Int. Cl.

| | |
|---|---|
| ***A47L 13/12*** | (2006.01) |
| ***A47L 13/142*** | (2006.01) |
| ***A47L 13/20*** | (2006.01) |
| ***A47L 13/14*** | (2006.01) |
| *A46B 15/00* | (2006.01) |
| *A46B 9/02* | (2006.01) |

(52) U.S. Cl.

CPC ..... *A47L 13/12* (2013.01); *A47L 13/14* (2013.01); *A47L 13/142* (2013.01); *A47L 13/20* (2013.01); *A46B 9/02* (2013.01); *A46B 15/0055* (2013.01); *A46B 15/0095* (2013.01); *A46B 2200/3033* (2013.01)

(58) Field of Classification Search

CPC ..... A47L 13/14; A47L 13/142; A47L 13/12; A47L 13/20; A47L 13/24

USPC ..... 15/116.1, 119.1, 119.2–120.2

See application file for complete search history.

(56) References Cited

U.S. PATENT DOCUMENTS

| | | | |
|---|---|---|---|
| 937,007 | A | 10/1909 | McLaughlin |
| 957,025 | A | 5/1910 | Zachry |
| 1,073,612 | A | 9/1913 | Lockhart |
| 1,138,922 | A | 5/1915 | Mien |
| 1,273,768 | A | 7/1918 | Gillam |
| 1,473,563 | A | 11/1923 | Julson |
| 1,557,894 | A | 10/1925 | Sturgis |
| 1,709,622 | A | 4/1929 | Justis |
| 2,905,958 | A | 9/1959 | Sannes |
| 3,364,512 | A | 1/1968 | Yamashita et al. |
| 3,462,788 | A | 8/1969 | Abbott |
| 3,946,457 | A | 3/1976 | Robinson |

(Continued)

FOREIGN PATENT DOCUMENTS

| | | |
|---|---|---|
| DE | 3607121 A1 | 9/1987 |
| DE | 10235307 A1 | 2/2004 |

(Continued)

OTHER PUBLICATIONS http://www.ocedar.com/main.taf?erube_fh=ocedar&ocedar.submit.getProductDetails=1&ocedar.productid=23, last accessed Mar. 3, 2011.

(Continued)

*Primary Examiner* — Laura C Guidotti

(74) *Attorney, Agent, or Firm* — Banner & Witcoff, Ltd.

(57) ABSTRACT

Novel cleaning implements and novel components of cleaning implements are provided. Aspects relate to a cleaning implement that includes a wringer structure that is slidable along an elongate shaft member. The wringer structure further includes a removably coupled scrubbing brush structure.

20 Claims, 10 Drawing Sheets

(56) References Cited

U.S. PATENT DOCUMENTS

| | | | | |
|---|---|---|---|---|
| 4,593,430 | A | 6/1986 | Spangler et al. | |
| D290,892 | S | 7/1987 | Slany | |
| 4,809,287 | A | 2/1989 | Ohba et al. | |
| 5,060,338 | A | 10/1991 | Yates et al. | |
| 5,509,163 | A | 4/1996 | Morad | |
| 5,577,290 | A | 11/1996 | Monahan | |
| 5,581,839 | A | 12/1996 | Ferrell, Jr. | |
| 5,615,442 | A | 4/1997 | Schroeck et al. | |
| 5,642,551 | A | 7/1997 | Cann et al. | |
| 5,675,857 | A | 10/1997 | Hirse | |
| D387,526 | S | 12/1997 | Berti et al. | |
| D387,527 | S | 12/1997 | Specht | |
| 5,724,694 | A | 3/1998 | Lewis | |
| 5,727,281 | A | 3/1998 | Harper | |
| D394,352 | S | 5/1998 | Berti | |
| 5,819,356 | A | 10/1998 | Cann | |
| 5,842,810 | A | 12/1998 | Morad | |
| 5,875,509 | A | 3/1999 | Facca | |
| D414,342 | S | 9/1999 | Ancona et al. | |
| 5,976,266 | A | 11/1999 | Anderson et al. | |
| 5,996,161 | A | 12/1999 | Facca | |
| 6,006,392 | A | 12/1999 | Seculov et al. | |
| 6,058,549 | A | 5/2000 | Milward-Bason | |
| 6,085,378 | A * | 7/2000 | Petner | A47L 13/144 15/116.1 |
| 6,088,867 | A | 7/2000 | Stefani et al. | |
| 6,108,848 | A | 8/2000 | Monahan | |
| 6,115,869 | A | 9/2000 | Libman | |
| 6,125,494 | A | 10/2000 | Morad | |
| 6,178,581 | B1 * | 1/2001 | Lewis | A47L 13/12 15/116.2 |
| 6,212,727 | B1 | 4/2001 | Bendor | |
| 6,212,728 | B1 | 4/2001 | Facca et al. | |
| 6,427,280 | B1 | 8/2002 | Specht | |
| D462,179 | S | 9/2002 | Lai et al. | |
| 6,477,731 | B2 | 11/2002 | Monahan | |
| D469,614 | S | 2/2003 | Libman | |
| D474,869 | S | 5/2003 | Libman | |
| D479,024 | S | 8/2003 | Libman | |
| 6,625,838 | B2 | 9/2003 | Laux et al. | |
| RE38,380 | E | 1/2004 | Libman et al. | |
| 6,732,396 | B2 | 5/2004 | Laux et al. | |
| 6,745,429 | B2 | 6/2004 | Ng | |
| D496,532 | S | 9/2004 | Hay | |
| 6,865,768 | B2 | 3/2005 | Chen | |
| 6,892,415 | B2 | 5/2005 | Libman et al. | |
| 6,941,608 | B1 | 9/2005 | Morad et al. | |
| 7,000,281 | B1 | 2/2006 | Morad | |
| D522,702 | S | 6/2006 | Libman et al. | |
| 7,065,823 | B2 | 6/2006 | Llanes | |
| 7,089,622 | B2 | 8/2006 | Sampaio | |
| 7,093,315 | B2 | 8/2006 | Cavalheiro | |
| D532,569 | S | 11/2006 | Libman et al. | |
| D542,493 | S | 5/2007 | Berti | |
| D544,161 | S | 6/2007 | Weaver | |
| 7,225,495 | B2 | 6/2007 | Berti et al. | |
| D547,542 | S | 7/2007 | Vellrath | |
| 7,260,864 | B1 | 8/2007 | Morad | |
| 7,260,865 | B2 | 8/2007 | Lesley et al. | |
| 7,334,285 | B1 | 2/2008 | Morad et al. | |
| D599,969 | S | 9/2009 | Weis | |
| 7,584,518 | B1 | 9/2009 | Morad | |
| D606,270 | S | 12/2009 | Weis et al. | |
| 7,624,469 | B2 * | 12/2009 | Specht | A47L 13/12 15/115 |
| 7,636,979 | B1 | 12/2009 | Morad et al. | |
| 7,640,616 | B2 | 1/2010 | Peterson | |
| 7,891,039 | B2 | 2/2011 | Lin | |
| 8,046,863 | B2 | 11/2011 | Berti et al. | |
| D656,696 | S | 3/2012 | Libman et al. | |
| D664,364 | S | 7/2012 | Gold et al. | |
| 8,402,589 | B2 * | 3/2013 | Berti | A47L 13/142 15/120.1 |
| 8,584,300 | B2 | 11/2013 | Weis | |
| D698,112 | S | 1/2014 | Molinet et al. | |
| D701,663 | S | 3/2014 | Michels et al. | |
| 8,904,591 | B2 | 12/2014 | Vosbikian et al. | |
| 8,925,134 | B2 | 1/2015 | Vosbikian et al. | |
| D745,761 | S | 12/2015 | Berti | |
| D746,009 | S | 12/2015 | Berti | |
| 9,247,804 | B2 | 2/2016 | Butler | |
| D822,928 | S | 7/2018 | Gooden | |
| D824,129 | S | 7/2018 | Gooden | |
| 10,188,258 | B2 | 1/2019 | Deveau | |
| 2002/0029433 | A1 | 3/2002 | Libman | |
| 2002/0092105 | A1 | 7/2002 | Laux et al. | |
| 2002/0108197 | A1 | 8/2002 | Specht | |
| 2002/0116780 | A1 | 8/2002 | Young | |
| 2002/0133892 | A1 | 9/2002 | Monahan | |
| 2003/0213079 | A1 | 11/2003 | Libman et al. | |
| 2004/0016072 | A1 | 1/2004 | Libman et al. | |
| 2004/0128783 | A1 | 7/2004 | Lesley et al. | |
| 2005/0022327 | A1 | 2/2005 | Cavalheiro | |
| 2006/0016031 | A1 | 1/2006 | Llanes | |
| 2006/0016032 | A1 | 1/2006 | Libman et al. | |
| 2006/0021171 | A1 | 2/2006 | Niccolai | |
| 2006/0026785 | A1 | 2/2006 | Sampaio | |
| 2006/0150353 | A1 | 7/2006 | Cavalheiro | |
| 2006/0225234 | A1 | 10/2006 | Petner | |
| 2007/0143941 | A1 | 6/2007 | Shih | |
| 2007/0151057 | A1 | 7/2007 | Petner et al. | |
| 2007/0186363 | A1 | 8/2007 | Chiang | |
| 2007/0226929 | A1 | 10/2007 | Kao | |
| 2007/0277337 | A1 | 12/2007 | Bizzotto | |
| 2008/0010768 | A1 | 1/2008 | Lesley | |
| 2008/0092315 | A1 | 4/2008 | Lin | |
| 2009/0025163 | A1 | 1/2009 | Specht et al. | |
| 2009/0165231 | A1 | 7/2009 | Libman et al. | |
| 2009/0165232 | A1 | 7/2009 | Libman | |
| 2009/0260169 | A1 | 10/2009 | Chen | |
| 2009/0307855 | A1 | 12/2009 | Kao | |
| 2010/0218327 | A1 | 9/2010 | Chen | |
| 2011/0094047 | A1 * | 4/2011 | Gold | A46B 9/02 15/172 |
| 2011/0308025 | A1 | 12/2011 | Vosbikian et al. | |

FOREIGN PATENT DOCUMENTS

| | | | |
|---|---|---|---|
| EP | 739600 | A1 | 10/1996 |
| EP | 1180341 | A2 | 2/2002 |
| ES | 2117588 | A1 | 8/1998 |
| FR | 2595234 | A1 | 9/1987 |
| FR | 2873053 | A1 | 1/2006 |
| FR | 2915074 | A1 | 10/2008 |
| GB | 1586313 | A | 3/1981 |
| JP | H05199974 | A | 8/1993 |
| NL | 2000800 | C1 | 2/2009 |
| WO | 9507046 | A1 | 3/1995 |
| WO | 96/32048 | A1 | 10/1996 |
| WO | 2004021851 | A1 | 3/2004 |

OTHER PUBLICATIONS

Ittp://www.homedepotcom/h_d1/N-5yc1v/R-100535273/h_d2/ProductDisplay?angld=1&storeld=100518catalogld=10053, last accessed Mar. 3, 2011.

http://www.amazon.com/Mr-Clean-Express-Mop-1-30-Pound/dp/B003ZYM06U/ref=sr_1_219?s=hpc&ie=UTF8&qid=12989210118sr=1-219, last accessed Mar. 3, 2011.

http://www.amazon.com/Leifheit-55401-Twister-Replacement-Head/dp/B002BU4EVI/ref=sr_1_164?s=hpc&ie=UTF8&qid=1298920716&sr=1-164, last accessed Mar. 2011.

http://www.amazon.com/Quickie-Mfg-0911-Wringer-Refill/dp/B001D4J281/ref=sr_1_132? s=hpc&ie=UTF8&qid=1298920517&sr=1-132, last accessed Mar. 3, 2011.

http7/www.amazon.com/Quickie-Twist-Refill-Mops-Cotton/dp/B000ASERBU/ref=sr_1_126? s=hpc&ie=UTF8&qid=1298920394&sr=1-126, last accessed Mar. 3, 2011.

http://www.amazon.com/Casabella-09529-Microfiber-String-Refill/dp/B001DVUYRE/ref=pd sim hi 1, last accessed Mar. 3, 2011.

http://www.amazon.com/Casabella-09452-Microfiber-String-Wring/

(56) References Cited

OTHER PUBLICATIONS dp/B0018HFOLO/ref=sr_1_116?s=hpc&ie=UTF8&qid=1298920082
&sr=1-116, last accessed Mar. 3, 2011.
http://www.amazon.com/Leifheit-55400-Twister-Handled-Bucket/
dp/B002BUBA8S/ref=sr_1_71? s=hpc&ie=UTF8&qid=1298919749
&sr=1-71, last accessed Mar. 3, 2011.
http://www.roundeyesupply.com/ProductDetails.asp?ProductCode=
DE423839&Click=882, last accessed Mar. 3, 2011.
http://www.amazon.com/O-Cedar-Frudenberg-120325-VILEDA/dp/
BOOOBSY980/ref=pd_sbs_k_21, last accessed Mar. 3, 2011.
http://www.amazon.com/LIBMAN-CO-02001-WONDER-REFILL/
dp/0001BBFLCO/ref=pd_sim_k_3, last accessed Mar. 3, 2011.
Dec. 13, 2012—(AU) Office Action—App 2012201174.
Jul. 31, 2013—(JP) Office Action—App 2012-041871—Eng Tran.
Aug. 1, 2013—(EP) Partial Search Report—App 12157849.6.

* cited by examiner

CLEANING IMPLEMENT

BACKGROUND

One type of mop that has found commercial success is in the marketplace is a mop having an attached wringer cup, like the one disclosed in U.S. Pat. No. 6,920,664. Other examples may be found in U.S. Pat. Nos. 7,520,018; 7,921,498; 8,402,589; and 8,719,991.

The mop fibers and wringer cups used on these kinds of mops are effective cleaning tools. However, in some instances, a soiled surface may require additional scrubbing forces to be applied in order to loosen the soiling material such that it may be mopped up. What is needed, therefore, is an improved cleaning implement that facilitates mopping and scrubbing functions.

SUMMARY

In light of the foregoing background, the following presents a simplified summary of the present disclosure in order to provide a basic understanding of some aspects of the various implementations of this disclosure. This summary is not an extensive overview of the embodiments described herein. It is not intended to identify key or critical elements, or to delineate the scope of the embodiments described in this disclosure. The following summary merely presents some concepts of the embodiments of this disclosure in a simplified form as a prelude to the more detailed description provided below.

Aspects of this disclosure relate to an innovative cleaning implement that has an elongate member with a first end and a second end along a vertical axis, and a connection assembly configured to be mounted on the second end of the elongate member and to secure mop fibers to the elongate member. The cleaning implement may also include a wringer that is configured to be slidably positioned along at least a portion of the elongate member. The wringer may additionally include an upper end, and a lower end that has multiple convex regions that extend around a lower perimeter. The wringer may also include an attachment structure that is rigidly coupled to one of the convex regions, with the attachment structure configured to removably couple a scrubbing brush to the wringer.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

A more complete understanding of the present invention and certain advantages thereof may be acquired by referring to the following detailed description in consideration with the accompanying drawings, in which.

DETAILED DESCRIPTION

In the following description of various example structures, reference is made to the accompanying drawings, which form a part hereof, and in which are shown by way of illustration various example cleaning implements, wringers, and connection assemblies in accordance with various embodiments Additionally, it is to be understood that other specific arrangements of parts and structures may be utilized and structural and functional modifications may be made without departing from the scope of this disclosure. Also, while the terms "top," "bottom," "front," "back," "rear," "right," "left," and the like may be used in this specification to describe various example features and elements, these terms are used herein as a matter of convenience, e.g., based on the example orientations shown in the figures and/or the orientations in typical use.

Figure 1:
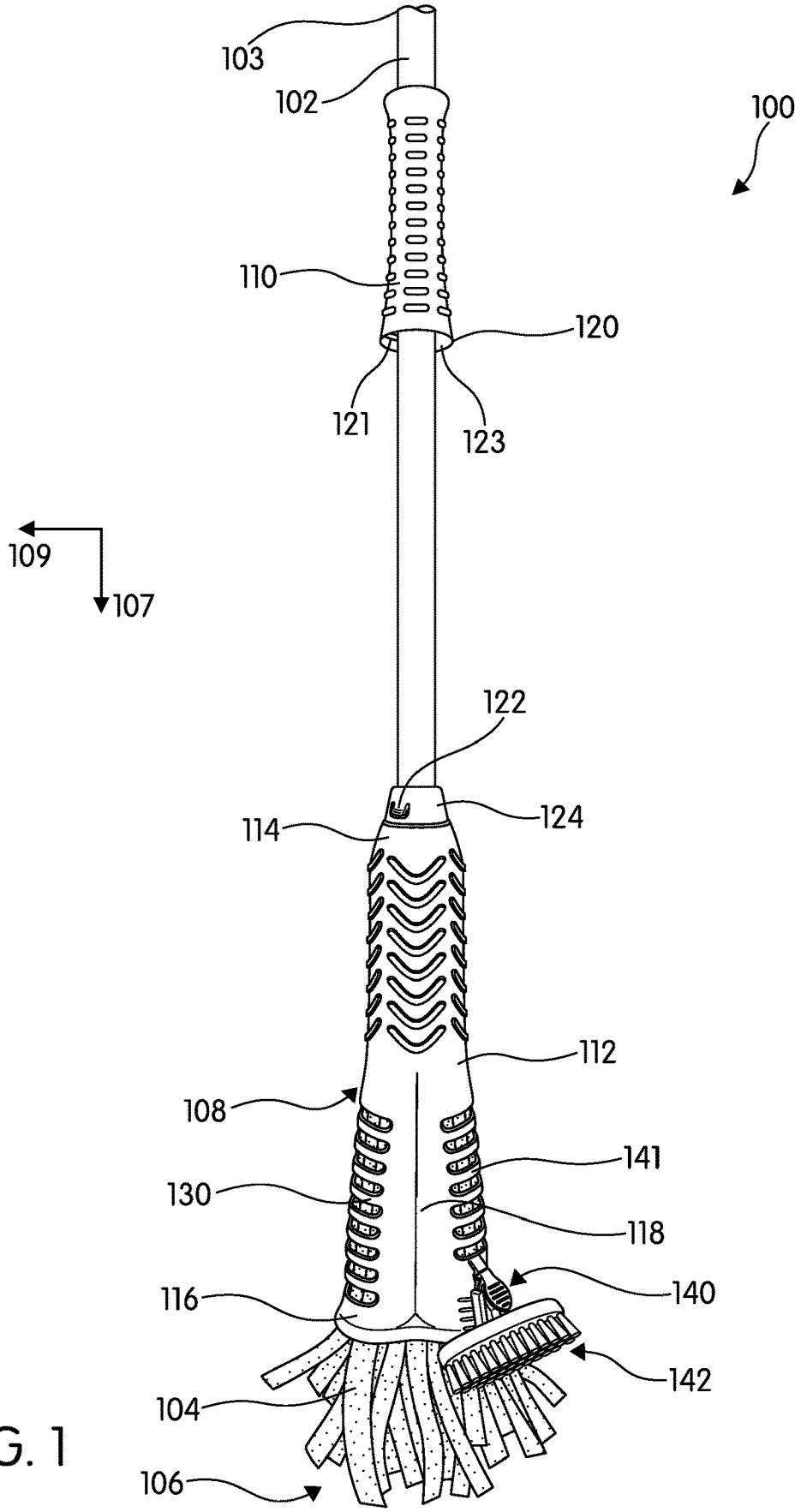
FIG. 1 depicts one embodiment of an illustrative cleaning implement in a closed position, according to one or more aspects described herein.

FIG. 1 depicts one embodiment of an illustrative cleaning implement 100, according to one or more aspects described herein. The depicted cleaning implement 100 may include an elongate member 102, which may otherwise be referred to as a shaft 102. The cleaning implement 100 also includes a set of mop elements 104 on an end 106 of the elongate member 102, and a wringer cup 108, otherwise referred to as a wringer 108 or a sheath structure 108. It is conventionally known that the elongate member 102 for such mops can be a lightweight metal tube. However, any rigid structure, including wood and or plastic may be employed. The illustrated elongate member 102 includes an optional hand grip 110. In one example, the handgrip 110 is configured to be removably coupled to the wringer 108 as the wringer 108 is slidable along the elongate member 102 and configured to be removably coupled to the handgrip 110 by an interference fitting.

The mop elements 104 that are illustrated take the form of flat strips. It is conventionally known that such strips can be made from (for example) water-absorbing non-woven fibrous material that may be, in one example, 18 or 19 inches long and about 0.15 inch thick in its non-compressed state. Other materials could also be used. The mop elements 104 are connected to the elongate member 102 by a connection assembly 113. The elongate member 102 has a first end 103 and a second end 105 spaced apart along a vertical axis of the cleaning implement 100. This vertical axis is substantially parallel to axis 107 schematically depicted in FIG. 1, and substantially perpendicular to horizontal axis 109 Accordingly, the connection assembly 113 may be implemented as a polymeric collar that is configured to couple the elements 104 to the second end 105 of the shaft of the elongate member 102. In one example, axis 107 may be parallel to the y-axis depicted in FIG. 3A, and axis 109 may be in the same plane as x-axis from FIG. 3A.

The depicted wringer cup 108 may be disposed on the elongate member 102 above the mop elements 104. The wringer 108 may have an outer wall 112 that extends between an upper end 114 and a lower end 116 of the wringer 108. Further, the outer wall 112 may taper outwardly toward the lower end 116. The wringer cup 108 may be slidably mounted on the elongate member, such as member 102, and may take the form of a tubular shell that can be molded in one piece from a polymeric material such as polypropylene. The wringer cups may include ribs 118 that help to squeeze liquid from the mop fibers during wringing.

Figure 2:
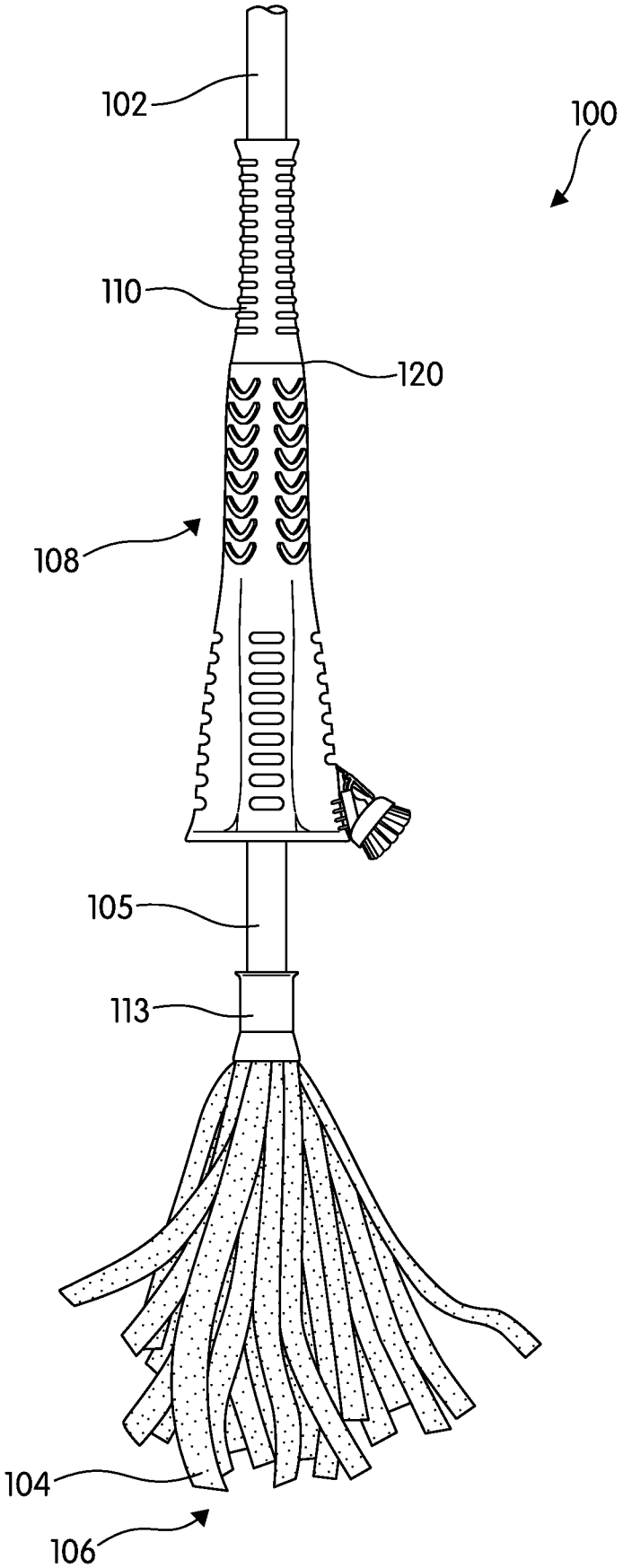
FIG. 2 depicts the cleaning implement of FIG. 1 in an open position, according to one or more aspects described herein.

The optional hand grip 110 is mounted on the elongate member 102 above the mop elements 104. The hand grip 110 is arranged to hold the wringer cup 108 above the mop elements fibers 104 when the mop 100 is being used. This position is illustrated in FIG. 2, in which an upper end 114 of the wringer cup 108 is removably coupled to a lower end 120 of the hand grip 110. The position of the wringer 108 depicted in FIG. 2 may be referred to as an open position, and the position of the wringer 108 depicted in FIG. 1 may be referred to as a closed position. In one implementation, the removable coupling of the hand grip 110 to the wringer 108 may be implemented using one or more flexures 122 configured to form an interference fit with a rim 121 that extends out from the inner sidewall 123 of the lower end 120 of the hand grip 110.

The mop elements 104, which may also be referred to collectively as a mop head 104, tend to be highly absorbent so as to allow the mop 100 to pick up spills. This absorbency means, however, that when removing the water from the mop elements 104, the water in the vicinity of the mop elements 104 tends to be re-absorbed. The perforations 130 in the wringer cup 108 help allow the water being squeezed from the mop elements 104 to be transported away so as to reduce re-absorption. Various embodiments have different sized perforations 130 and different configurations, without departing from the scope of these disclosures.

The wringer 108 additionally includes an attachment structure 140 that is configured to be removably coupled to a scrubbing brush 142. In one example, the attachment structure 140 is integrally formed with the wringer 108. In another example, the attachment structure 140 is formed as a separate structure to the wringer 108, and rigidly coupled to the wringer 108. The attachment structure 140 is positioned on one of the convex regions 141 of the wringer 108. In one example, the wringer 108 has four such convex regions 141 spaced around a perimeter of the wringer 108. These convex regions are described in further detail in relation to FIGS. 3A-3D, and are referred to as convex regions 324-330 in those figures. The attachment structure 140 may be coupled to the lower end 116 of the wringer 108. Further, the surface onto which the attachment structure 140 is formed may not include any perforations 130. In certain examples, an end of the attachment structure 140 is positioned between 3 and 15 mm from the lower end 116 of the wringer 108. In one example, the scrubbing brush 142 is configured to be coupled to and decoupled from the wringer 108 using the attachment structure 140, whereby the scrubbing brush slides onto the attachment structure 140 in a direction substantially parallel to axis 107.

Figure 3A:
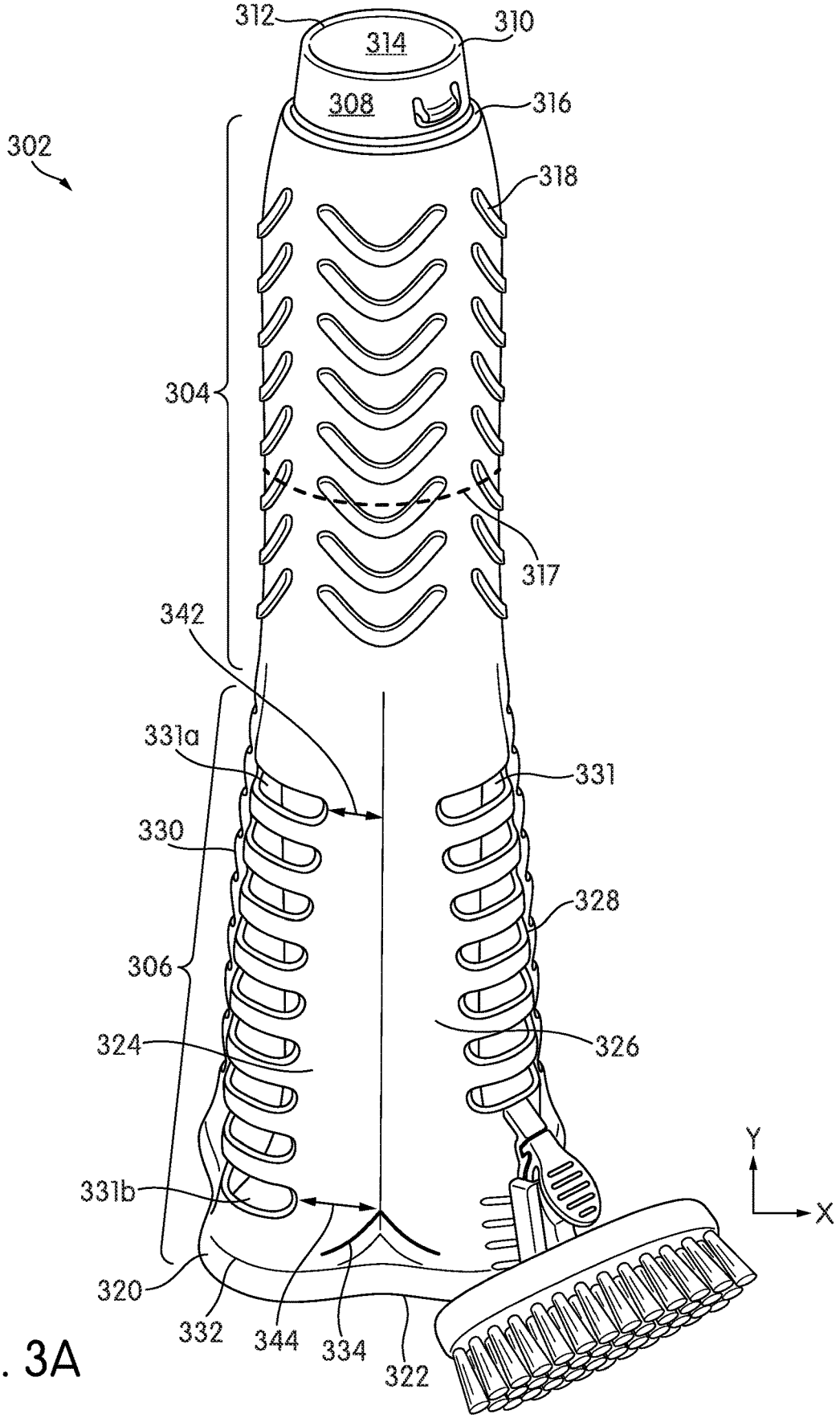
FIGS. 3A-3D depict respective perspective, side, bottom and top views of a wringer structure, according to one or more aspects described herein.

FIG. 3A depicts a perspective view of exemplary wringer 302, according to one or more aspects described herein. The wringer 302 may be similar to wringer 108, depicted in FIG. 1. Further, the scrubbing brush 350 may be similar to scrubbing brush 142, and attachment structure 352 may be similar to attachment structure 140. Wringer 302 may comprise a unitary body having upper end 304 and a lower end 306 along a vertical axis (such as the y-axis). In one embodiment, wringer 302 may be about 25 to about 30 centimeters in length along the y-axis. In yet other embodiments, it may be about 28 to about 29 centimeters. In still yet further embodiments, wringer 302 may be about 28.5 centimeters in length. However, it is contemplated that the wringer 302 may have any length, without departing from the scope of these disclosures. Indeed, it is contemplated that none of the disclosures throughout this description should be limited to any specific dimensional values or relative proportions.

The upper end 304 may have a terminus 308 defining a first outer perimeter (perimeter 310). In certain embodiments, outer perimeter 310 may be substantially circular or oval. Terminus 308 may further include a first inner perimeter 312 defining a central bore 314. Central bore 314 may be configured to permit passage of the elongate member 102 into the interior of wringer 302. Therefore, in some implementations, central bore 314 may be substantially circular. In other implementations, however, the size and shape of central bore 314 may vary.

Figure 3B:
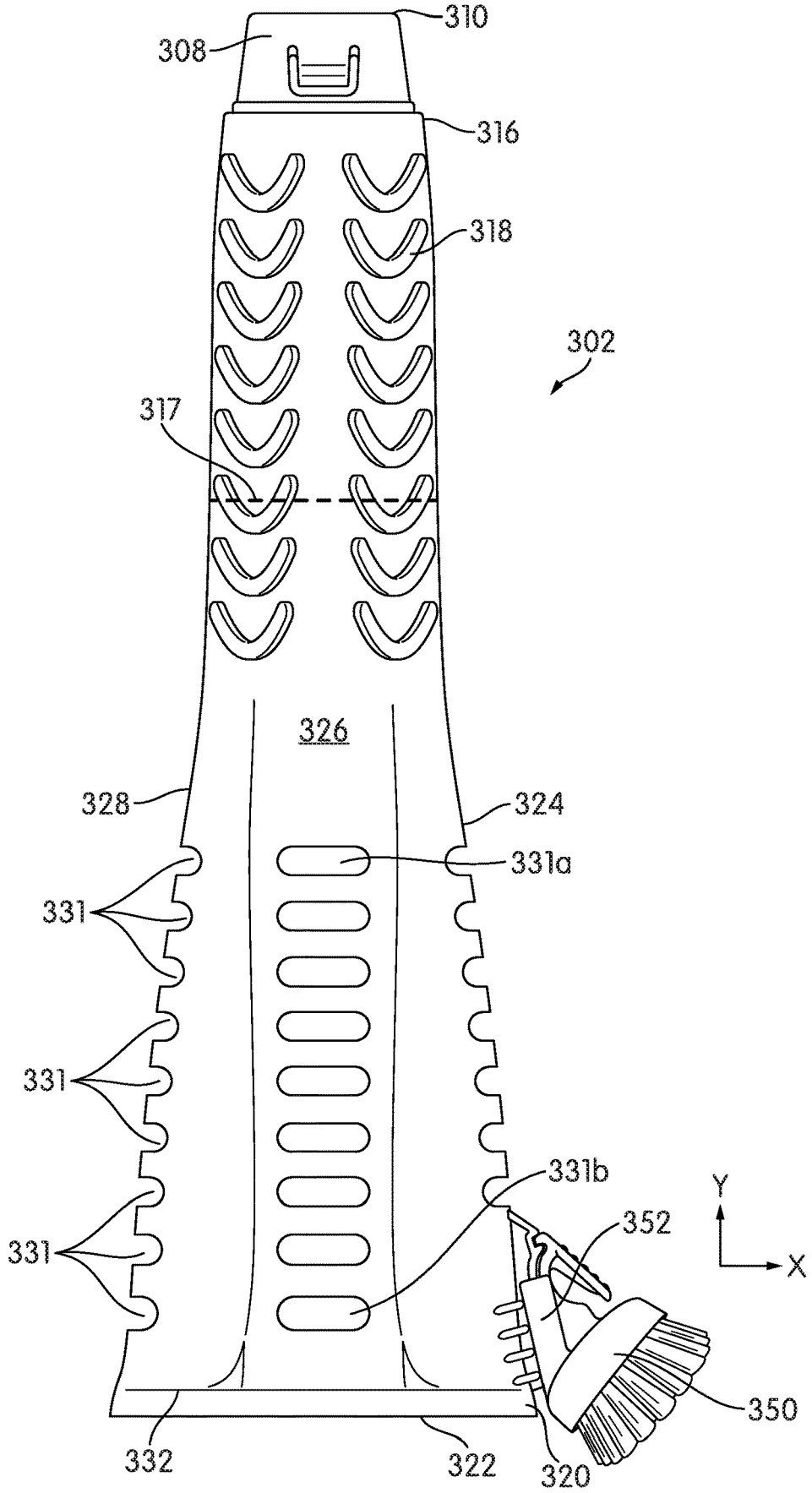

In addition to terminus 308, other portions of upper end 304 may have a circular or oval perimeter with respect to the horizontal axis (horizontal x-axis depicted in FIG. 3A). In one implementation, at least a portion of the upper end 304 may be cylindrical (e.g., as depicted in FIG. 3B and the bottom view shown in FIG. 3C). For example, looking first to FIG. 3B, perimeter 310 may be substantially circular with respect to the horizontal plane of FIG. 3B. In the illustrated implementation, perimeters 316 and 317 may also be substantially cylindrical. Accordingly, the cross-sectional area of wringer 302 between perimeter 316 and perimeter 317 of the illustrated example may be substantially cylindrical.

Figure 3C:
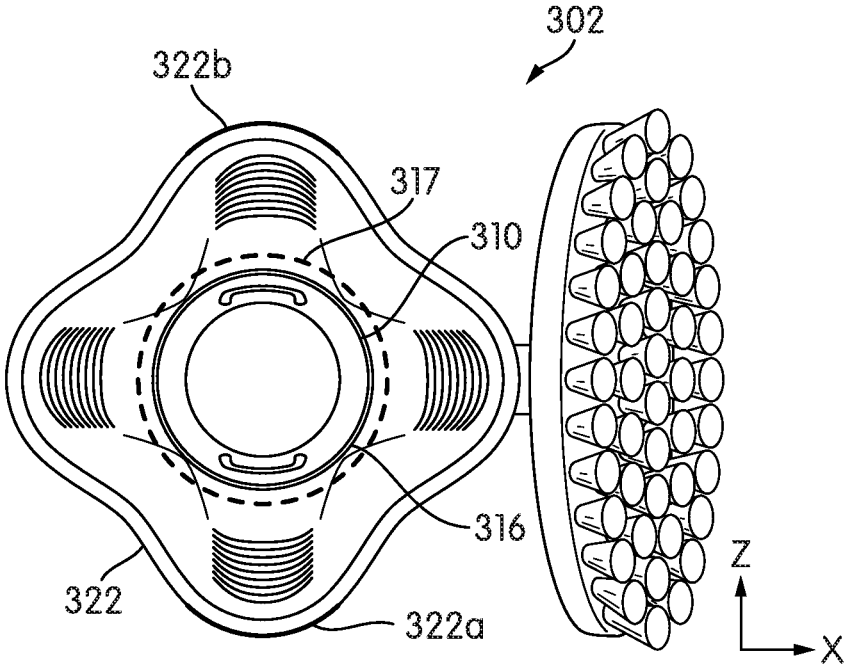

In one example, portions of upper end 304 may be more cylindrical than other portions. For example, terminus 306 may define a perimeter (i.e., perimeter 308) that is more cylindrical than a perimeter on a location of upper end 304 that is more proximate to the lower end 306, such as perimeter 317. In this regard, the cross-sectional area of upper portion 304 may become more conical or conic-cylindrical in shape as it approaches the lower end 306. FIG. 3C shows a bottom view of wringer 302. As seen in FIG. 3C, perimeters 310, 316 and 317 are each shown as concentric circles in which 310 is smaller than 316, which in turn is smaller than 317. Therefore, in the illustrative implementation, upper end 304 of wringer 302 may have a substantially cylindrical shape. However, upper end 304 of wringer 302 may have a slight conical-cylindrical three-dimensional structure. In further implementations, portions of upper end 304 may be devoid of a perimeter resembling a cylinder and/or an oval. As will be explained below in relation to a lower end 306 of wringer 302, the cross-sectional area or distance of wringer 302 at various portions of upper end 304 may be distinctly different from the cross-sectional area or distance of wringer 302 at various portions of the lower end 306.

Upper end 304 may be about 40% to about 60% of the entire length of wringer 302. In other embodiments, upper end 304 may be about 45% to about 55% or 47.5% to about 52.5% of the length of wringer 302. In yet another embodiment, upper portion 304 is about 50% of the length of wringer 302. In further embodiments, upper portion 304 may be about 12 to about 18 centimeters in length. In one embodiment, upper portion 304 may be about 15 to about 16 centimeters in length. In certain embodiments, upper portion 304 may be characterized in its absence of voids or protrusions for water removal during operation of the wringer 302.

Upper end 304 may be defined by the lack of the voids as well as a cylindrical shape that is distinct from the lower portion 306. Upper end 304 of wringer 302 may be substantially totally devoid of any voids with the exception of bore 314. For example, as shown in the illustrative implementation, upper end 304 may be devoid of any protrusions or voids for the drainage of water. Further discussions relating to various embodiments will be provided below in relation to exits 331. Upper end 304 may include one or more extrusions or elevated portions, such as structures 318. Structures 318 may be configured to be graspable by a user, for example, to maneuver the wringer 302 during operation. In certain embodiments, extrusions 318 may comprise one or more chevron-shaped patterns, or arc patterns.

Lower end 306 of wringer 302 may include a terminus 320 having a second outer perimeter (see, e.g., element 322). In certain embodiments, the second outer-perimeter 322 may not be circular or oval. This may be true even in embodiments in which upper end 304 is substantially cylindrical or conical-cylindrical and/or the first outer perimeter 310 is substantially circular or oval. Despite the second outer perimeter 322 not being an oval or circular in certain embodiments, it may comprise one or more convex, concave, curvy and/or rounded components. In the illustrative implementation, the second outer perimeter 322 encompasses a larger cross-sectional surface area than the first outer perimeter 310. Further features of perimeter 322 will be provided in more detail below. Additionally, perimeter 322 may include one or more features or qualities described in relation to ledge 332 and vice-versa. It is to be understood, however, that in certain embodiments, ledge 332 comprises perimeter 322. Yet in other implementations, ledge 332 is absent from the wringer 302.

In one implementation, perimeter 322 and/or ledge 332 may be about 26.3 centimeters. In one implementation, perimeter 322 is about 2 times the length as perimeter(s) 310, 316 and/or 317. In one implementation, perimeter(s) 310, 316 and or 317 may be about 50-60% of perimeter 322. In another implementation, perimeter(s) 310, 316 and/or 317 may be about 55% of perimeter 322. In one implementation, the difference in cross-sectional area between perimeter(s) 310, 316 and/or 317 in the upper end 304 and perimeter 322 in the lower end 306 may be due to the presence of one or more convex or concave regions of the lower end 306, such as those disclosed below.

Lower end 306 of wringer 302 may include one or more convex regions 324-330. In the illustrated embodiment, convex regions 324-330 may include columns. Therefore, regions 324-330 may be referred to as "columns" throughout this disclosure in reference to the embodiment shown in FIG. 3A-3D but the reader is advised that the disclosure is not so limited. Convex regions/columns 324-330 may be substantially vertical. For example, in the illustrative embodiment, columns 324-330 are implemented such that the length is substantially straight, non-curvy (i.e., there is no bending along the horizontal axis)

As seen throughout FIGS. 3A-3D, columns 324-330 may be implemented as rounded components that may widen along the horizontal plane (see x-axis) as the distance from the upper end 304 increases and the distance towards the lower second outer perimeter 322 decreases. As shown best in FIG. 3D, columns 324-330 may terminate at ledge 332. In this regard, columns 324-330 may terminate proximate to the second outer perimeter 322 at ledge portions 332*a*-332*d*, which may be oval and/or circular. In certain embodiments, ledge portions 332*a*-332*d* are circular convex for at least 90 degrees. In yet further embodiments, ledge portions 332*a*-332*d* may be circular convex for at least 135 degrees, yet in other embodiments they may form half-circles and thus be about 180 degrees. In this regard, certain embodiments of convex regions 324-330 may be implemented as cross-sectional splices of conical or conical-cylindrical structures. For example, as best seen in FIG. 3C, perimeter 322 may comprise rounded component 322*a*.

In certain embodiments, a pair of rounded components (see components 322*a* and 322*b*) may be positioned in an opposing manner, such as shown in FIG. 3C. Those skilled in the art with the benefit of this disclosure will appreciate that any range of circular shapes is within the scope of this disclosure. Outer perimeter 322 may be substantially identical to ledge 332, such that corresponding portions of perimeter 322 have substantially the same shape as ledge 332 or those described in relation to ledge 332.

Convex regions/columns 324-330 may be positioned in an opposing manner, such as shown in FIG. 3C. In the illustrative embodiments, two pairs of rounded components are shown, each being about 90 degrees from each other with regard to the horizontal plane. In one embodiment, the positioning of the four convex regions 324-330 may be such that a generally square shape is formed (See FIG. 3D). In one such embodiment, a lower portion of the convex regions is more square shaped than the upper portion of the convex regions. In this regard, ledge 332 may be generally square-shaped. Those skilled in the art will appreciate that other shapes are within the scope of this disclosure.

Specific embodiments are directed towards the implementation of convex regions that provide a wringer 302 with a non-circular cross-sectional across a horizontal plane. Further implementations may utilize convex regions, including regions 324-330, such that the lower end 306 of the wringer 302 has an increased cross-sectional area when compared to the upper portion 304. In certain implementations, this may result in less pressure against the corresponding mop fibers. In further implementations, mop fibers having less pressure against the wringer 302 may permit the expansion of mop fibers when compared to inter-fiber proximity in the upper end 304 of the wringer 302. In certain implementations, decreased inter-fiber proximity may results in the improved water drainage over prior art systems and methods. For example, perimeter 322 may be substantially square shaped.

Figure 3D:
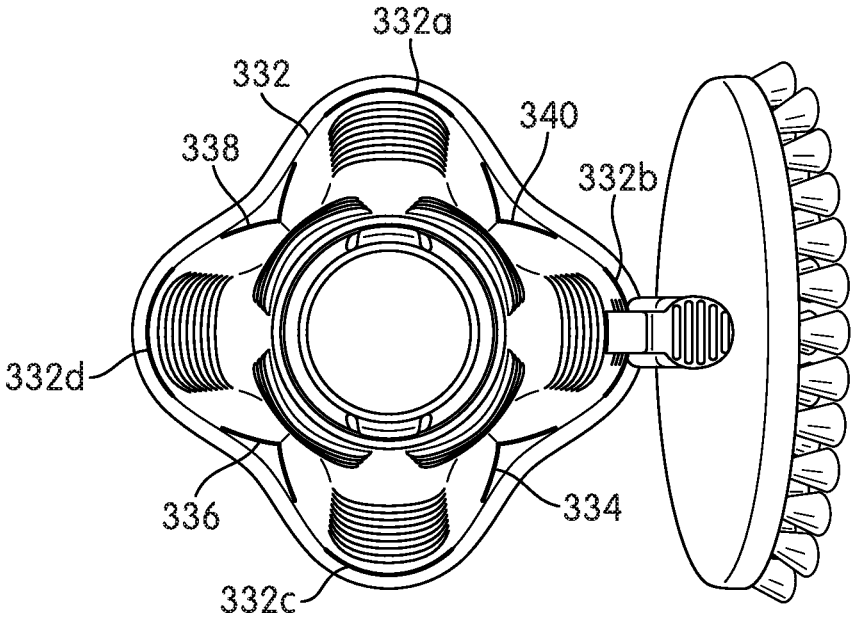

The outer perimeter 322 is not be limited to having opposing rounded surfaces or pairs of the same. Other shapes and configurations are within the scope of this disclosure. Further, certain embodiments are directed towards component being concave such as concave regions 334-340. (FIG. 3D shows the general shape of illustrative regions 334-340 as an imaginary line located proximate to ledge 332 and/or perimeter 322 and FIG. 3A shows a possible shape of a portion of concave region 334). Looking to FIG. 3A, concave region 334 may be formed by the presence of adjacent convex regions, such as regions 324 and 326. In certain embodiments, each of the concave regions 334-340 may be formed by the presence of adjacent convex regions, such as regions 324-330. For example, the joining of convex regions 324 and 326 forms concave region 334. Therefore, various locations on the surface may be part of a concave and a convex region. One or more concave regions may be substantially inverse to a convex region, such as 324-330.

Concave regions 334-340 may be described in some embodiments as a plurality of inward extending ribs. As seen in FIGS. 3A-3D, each rib comprising a first side and a second side that converge to form a rib bottom. The bottom may be the most-inner curvature of the concave regions 334-340. As explained in more detail below, concave regions 334-340 may be devoid of any drainage exits, therefore, in certain embodiments, the rib bottom and the rib sides may be substantially devoid of any perforations.

Similarly, convex regions 324-330 may be described in some embodiments as a plurality of outward extending ribs. As seen in FIGS. 3A-3D, each outward rib comprising a first side and a second side that converge to form a rib top. The top may be the outer-most curvature of the convex regions 324-330. As explained in more detail below, convex regions 324-330 may comprise drainage exits, therefore, in certain embodiments, the rib top and the rib sides may comprise perforations. In certain implementations, only the outer-most curvature of the convex regions 324-330 comprises perforations.

Adjacent convex regions 324-330 and concave regions 334-340 may share a common side. For example, a first side of a rib of a concave region may be a first or second side of a rib for a convex region. In certain implementations, the concavity of a concave region may be equal to the convexity of an opposing and/or adjacent convex region 324-330. In yet other implementations, one or more concave regions 334-340 may be unrelated to the shape and/or curvature of one or more convex regions 324-330. Concave regions 334-340 may widen along the horizontal plane (see x-axis) as the distance from the upper end 304 increases and the distance towards the lower second outer perimeter 322 decreases. As shown best in FIG. 3D, columns 334-340 may terminate at ledge 332.

The combination of convex regions 324-330 and concave regions 334-340 may provide improved drainage characteristics of over prior designs. In one implementation, the cross sectional area across the horizontal plane (along the x-axis) in lower end 306 of wringer 302 may resemble an "X". The cross-sectional diameter of the lower end 306 proximate to perimeter may be at least twice that of the corresponding cross-sectional diameter of the lower end 306 proximate to the upper end 304 of the wringer 302. In one implementation, cross-sectional diameter of the lower end 306 proximate to perimeter may about 200% of the corresponding cross-sectional diameter of the lower end 306 proximate to the upper end 304 of the wringer 302. In one implementation, the wringer's 302 circumference at a location of lower end 306 that is immediately adjacent to the upper end 304 may be substantially circular or oval and have a perimeter about 14 to about 15 centimeters and the location of the lower end 306 immediately adjacent to perimeter 322 may be non-circular or oval and have a perimeter of about 26 to about 27 centimeters.

The presence of concave regions 334-340 as disclosed may result in an application of pressure against at least an outer portion of mop fibers during use of the wringer 302. As shown in the illustrated implementation, each of the concave regions 334-340 may be substantially devoid of any drainage exits or ports, such as exits 331. One or more convex regions 324-330 may comprise drainage exits, such as plurality of exits 331. In certain implementations, drainage exits 331 may be positioned substantially along the length of convex regions 324-330. (For simplicity, exits 331 are not each individually labeled, however, it is apparent from FIGS. 3A-3D that the unmarked exits may form part of exits 331).

As shown in FIGS. 3A-3D, each of the regions 324-330 may comprise one or more exits, such as exits 331. In one implementation, plurality of exits 331 may be positioned along at least 75% of the vertical length (parallel to the elongate member 12 of FIGS. 1-4) of the convex regions 324-330. Yet in other implementations, plurality of exits may be at least along 80%, 85%, 90% or 95% of the vertical length of the convex region 324-330. In one embodiment, there may be 8 to 10 vertically arranged exits 331 positioned along the length of each region 324-330. In one embodiment, there are 9 exits 331 per region 324-330.

Positioning and/or placement of drainage exits 331 may be configured to provide improved drainage over existing designs. For example, as an outer portion of mop fibers contact the inner perimeter of convex regions 324-330 of the lower end 306, exits 331 may permit improved drainage capabilities. In this regard, draining exits 331 may only be provided on an outer most surface of the convex regions 324-330. In one implementation, only one exit is provided on any given horizontal plane for each column or convex region 324-330. For example, looking to FIGS. 3A-3D, exits 331 are provided as lateral slits having a horizontal lengths that are greater than their vertical height.

Upper most exit 331*a* of region 324 (or any other exit) may be about 0.5 centimeters in height and about 2 centimeters in length. In another implementation, exit 331*a* may be about 0.5 to about 0.7 centimeters in height and about 2.0 to about 2.2 centimeters in length. Having exits with a length greater than the height may be advantageous, either alone or in combination with other elements of this disclosure. In one embodiment, exit 331*a* and/or any of plurality of exits 331 may have a height that is about 25-30% of its length. In yet other embodiments, exit 331*a* and/or any of plurality of exits 331 may have a height that is about 28.5% of its length. Exit 331*a* may be at least about 1 centimeter away from the interior-most location of adjacent concave regions, such as region 334. This parameter is shown in FIG. 3A as 342.

In certain implementations, plurality of exits 331 may each have the same general shape, such as shown in FIGS. 3A-3D This, however, is not a requirement. Further, different exits with the plurality of exits 331 may have different dimensions relative to the dimensions of the convex regions 324-330. In one embodiment, as convex regions 324-330 expand away from the center of the wringer 302 dimensions of the corresponding exits may also change at a predictable rate. For example, exit 331*b* may be about 0.7 to about 0.9 centimeters in height and about 2.0 to about 2.2 centimeters in length. In one implementation, exit 331*b* may be about 0.8 centimeters in height and about 2.1 centimeters in length. In certain embodiments, exit 331*b* and/or any of plurality of exits 331 may have a height that is about 35-40% of its length. In other implementations, exit 331*b* and/or any other plurality of exits 331 may have a height that is about 38% of its length. Exit 331*b* may be at least about 2 centimeters away from the interior-most location of adjacent concave regions, such as region 334. This parameter is shown in FIG. 3A as 344.

Figure 4:
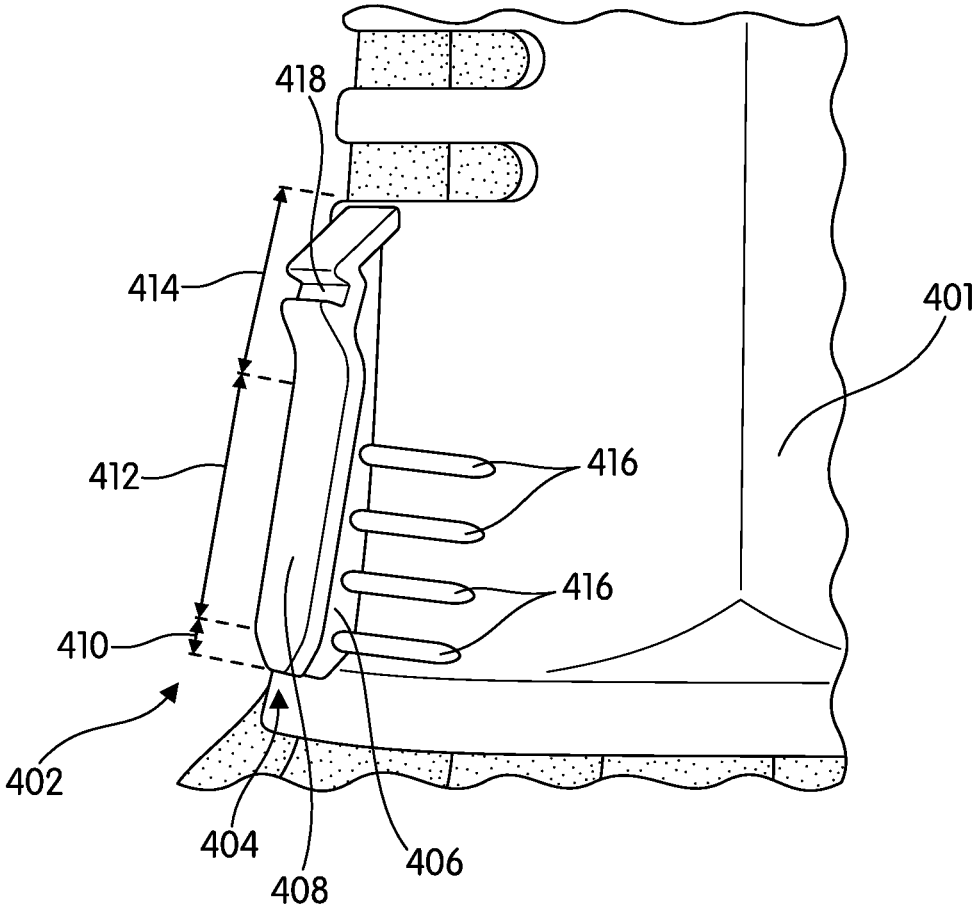
FIG. 4 depicts an attachment structure that is rigidly coupled to a wringer structure, according to one or more aspects described herein.

FIG. 4 depicts an attachment structure 402 that is rigidly coupled to a wringer structure 401. Accordingly, the attachment structure 402 may be similar to the attachment structure 140, and the wringer structure 401 may be similar to wringer structure 108. The attachment structure 402 includes a slide rail 404 that is configured to slide into a linear sleeve of a scrubbing brush (the linear sleeve is described in further detail in relation to FIG. 5). Accordingly, the slide rail 404 is offset from the side wall of the wringer structure 401 by a longitudinal spine element 406. The slide rail 404 includes a tapered portion 410, a linear portion 412, and a ramp portion 414. The longitudinal spine element 406 is integrally formed with the portions 410, 412, and 414. Accordingly, the coupling of the longitudinal spine element 406, and a substantially planar top surface 408 of the linear portion 412 combined with the longitudinal spine element 406 forms a substantially T-shaped cross-section. The longitudinal spine element 406 is further stabilized by lateral spines 416. While four lateral spines 416 are depicted in FIG. 4, it is contemplated that any number of spines, or different spine geometries may be utilized, without departing from the scope of these disclosures. The tapered portion 410 of the slide rail 404 may have a taper angle, and may be tapered toward the side wall of the wringer 401 in addition to being tapered along the plane of the planar top surface 408. A depression 418 or trough 418 may be form part of the ramp portion 414. Accordingly, the depression 418 may be configured to engage with a catch of a scrubbing brush, such as the scrubbing brush described in relation to FIG. 5. It is contemplated that the ramp portion 414 may have any angle geometry without departing from the scope of these disclosures. In one specific example, the ramp portion 414 may have a curvature between the end of the linear portion 412 and the depression 418.

Figure 5:
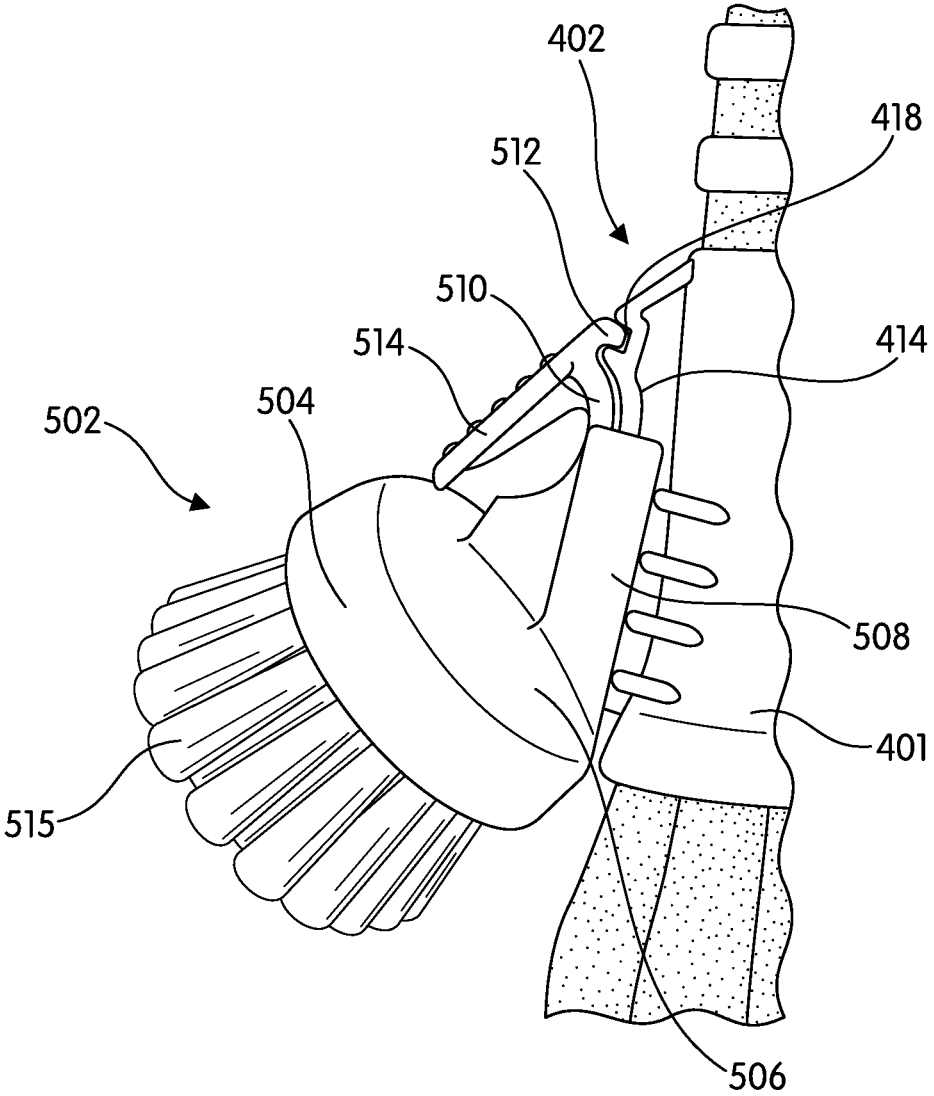
FIG. 5 depicts a scrubbing brush that is removably coupled to the wringer structure of FIG. 4, according to one or more aspects described herein.

FIG. 5 depicts a scrubbing brush 502 that is removably coupled to the wringer structure 401. It is contemplated that the scrubbing brush 502 may be formed from any polymeric material, or a combination of materials. For example, the scrubbing brush 502 may be formed from two or more polymers, or a fiber reinforced polymer or polymers, among others. It is also contemplated that the scrubbing brush 502 may be formed using any manufacturing processes, including, injection molding. The scrubbing brush 502 includes a base structure 504 and an attachment structure 506. The attachment structure 506 is configured to removably couple the scrubbing brush 502 to the attachment structure 402 of the wringer 401. The brush 502 additionally include a plurality of bristles 515. These bristles 515 may be formed from one or more polymeric materials. The scrubbing brush 502 may be similar to scrubbing brush 142. In one example, the attachment structure 506 includes a linear sleeve 508 that is configured to receive the slide rail 404. Flexibly coupled to the linear sleeve 508 is a flexure 510 that allows the catch structure 512 to rotate relative to the linear sleeve 508 as a result of application of a manual force to the flexure button 514. In particular, the flexure button 514 provides a surface onto which a manual force may be applied to rotate the flexure 514 relative to the linear sleeve 508. As depicted, the geometry of the flexure 510 and catch structure 512 corresponds to the geometry of the ramp portion 414 of the slide rail 404. The catch structure 512 is configured to be received into the depression 418 and retain the scrubbing brush 502 on the attachment structure 402 of the wringer 401 using an interference fit. Accordingly, the linear sleeve 508 has a substantially U-shaped cross-section configured to receive the T-shaped cross-section of the slide rail 404. The geometry of the U-shaped cross-section of the linear sleeve 508, in combination with the interference fit of the catch 512 with the depression 418 prevents the scrubbing brush 502 from moving in any direction. This removable coupling of the scrubbing brush 502 to the wringer structure 401 allows the scrubbing brush 502 to be used to scrub soiled surfaces while attached to the wringer structure 401. In one example, the scrubbing brush 502 may be utilized when the wringer structure 401 is in the closed configuration or position depicted in FIG. 1. Optionally, the scrubbing brush 502 may be removed from the wringer 401 by manually actuating the catch 512. Advantageously, the scrubbing brush 502 may be cleaned or used to reach inaccessible areas when removed from the wringer 401.

Figure 6A:
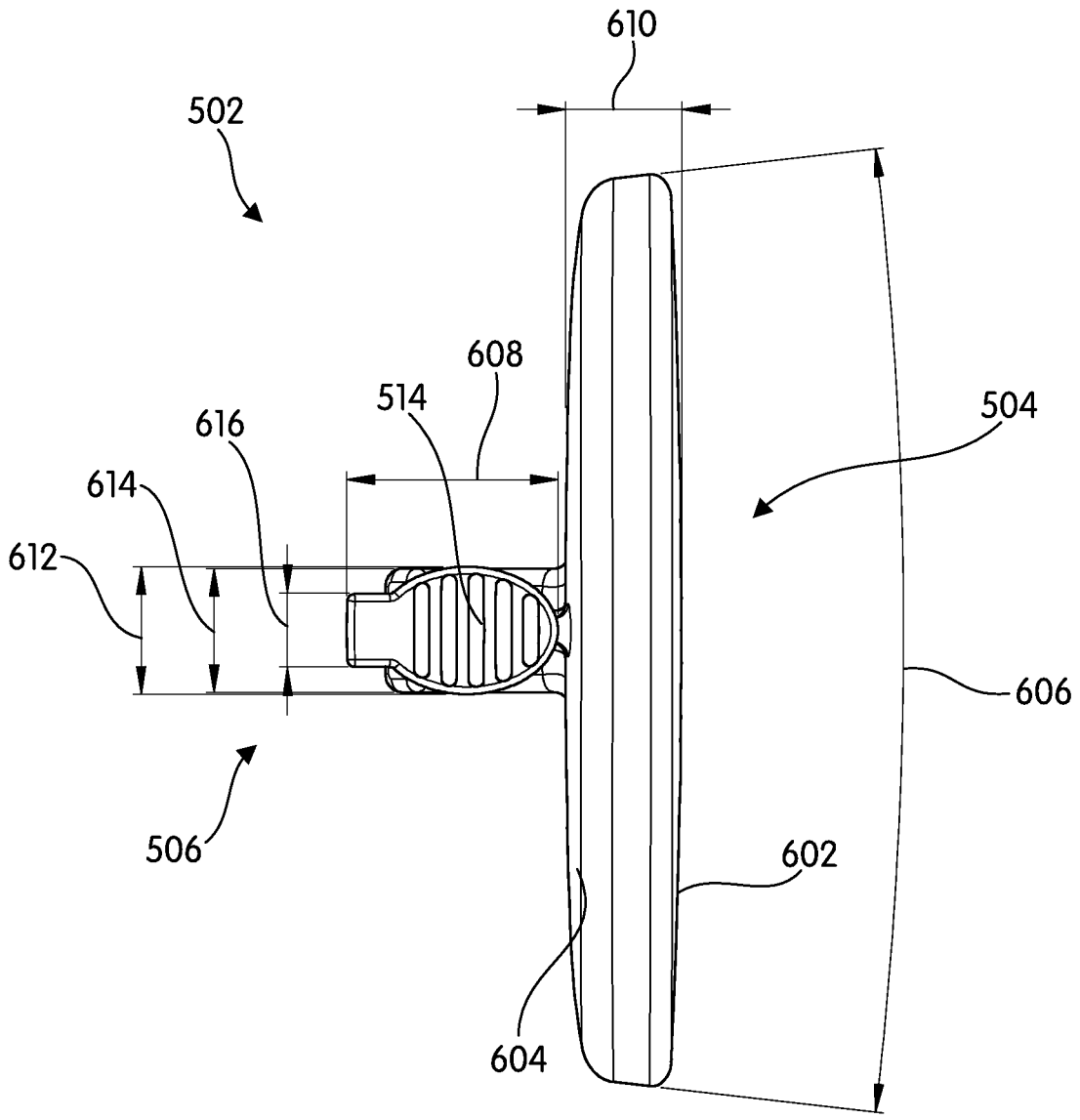
FIGS. 6A-6C depict respective plan, elevation and end views of a scrubbing brush, according to one or more aspects described herein.
Figure 6B:
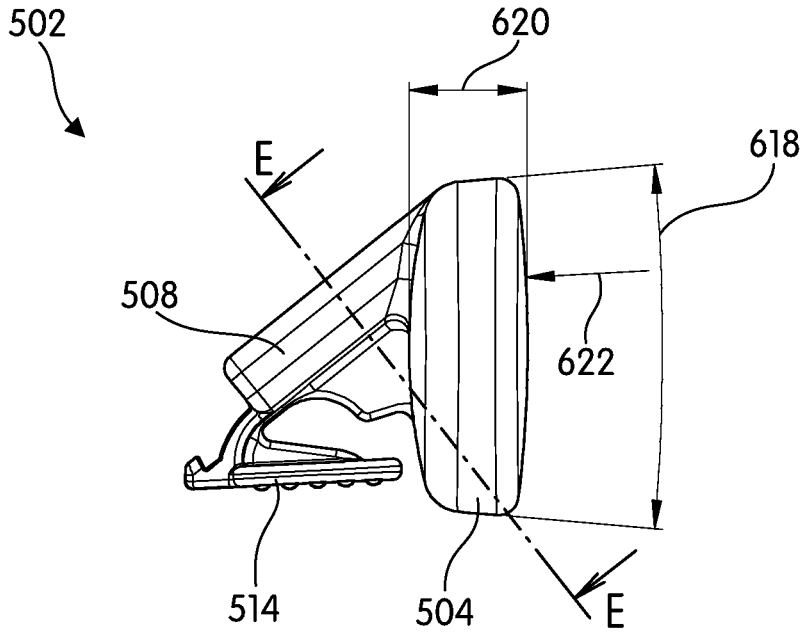
Figure 6C:
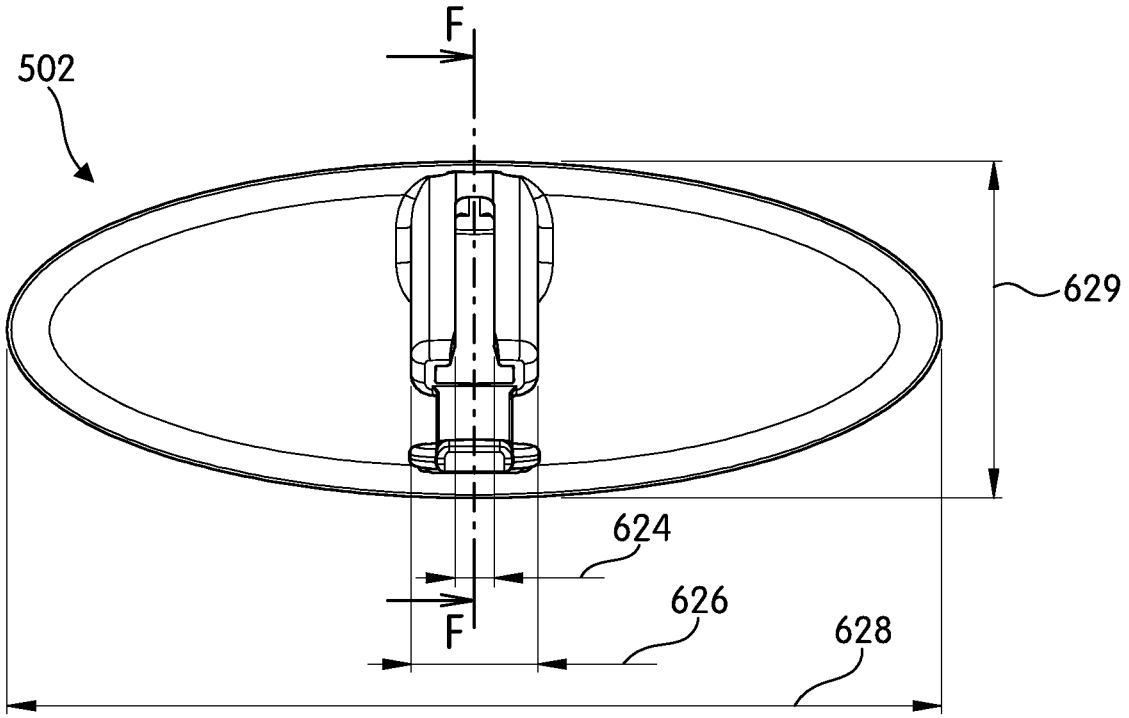

FIG. 6A depicts a plan view of the scrubbing brush 502, according to one or more aspects described herein. FIG. 6B depicts an elevation view of the scrubbing brush 502, according to one or more aspects described herein. FIG. 6C depicts an end view of the scrubbing brush 502, according to one or more aspects described herein. As depicted, the scrubbing brush 502 may have a substantially oval or elliptical shape with major axis 628 and minor axis 629. It is contemplated that different scrubbing brush geometries may be used with the same attachment structure mechanism, without departing from the scope of these disclosures. For example, the scrubbing brush may have a circular, square, rectangular, triangular, pentagonal, hexagonal, heptagonal, octagonal, nonagonal, or decagonal outer geometry (or have additional sides), without departing from the scope of these disclosures, and be configured to use the same attachment structure 506. Each of FIGS. 6A-6C depict the scrubbing brush 502 without any bristles. In one example, a plurality of bristles are coupled to the lower surface 602 of the base structure 504. The attachment structure 506 is coupled to an upper surface 604 of the base structure 504. FIGS. 6A-6C depict various dimensions of the scrubbing brush 502 as one example implementation. It is contemplated that the scrubbing brush 502 may have alternative dimensions and the relative sizes of the different structures that make up the scrubbing brush 502 may differ to those depicted, without departing from the scope of these disclosures. In one example, angle 606 may measure 13°. In another example, angle 606 may measure between 5° and 25°. Length 608 may measure 22.8 mm. In another example, length 608 may measure between 20 and 25 mm. Length 610 may measure 12.5 mm. In another example, length 610 may measure between 10 mm and 20 mm. Length 612 may measure 13.8 mm. In another example, length 612 may measure between 10 and 15 mm. Length 614 may measure 13.4 mm. In another example, length 614 may measure between 10 and 15 mm. Length 616 may measure 7.9 mm. In another example, length 616 may measure between 5 and 10 mm. Angle 618 may measure 10°. In another example, angle 618 may measure between 7 and 15°. Radius of curvature 622 may have a value of 132 mm. In another example, radius of curvature 622 may have a value of between 110 and 150 mm. Length 620 may have a value of 12.4 mm. in another example, length 620 may measure between 10 and 15 mm. Length 624 may measure 4.1 mm. In another example, length 624 may measure between 2 and 7 mm. Length 626 may measure 13.4 mm. In another example, length 626 may measure between 10 and 16 mm. Length 628 may measure 99.5 mm. In another example, length 628 may measure between 90 and 110 mm. Length 629 may measure 35.3 mm. In another example, length 629 may measure between 30 and 40 mm.

Figure 7:
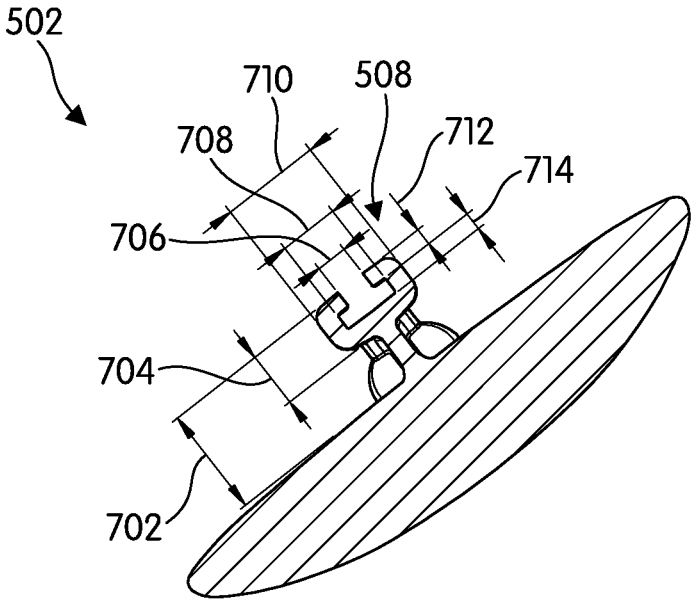
FIG. 7 is a cross-sectional view of a scrubbing brush sectioned along the plane E-E from FIG. 6B, according to one or more aspects described herein.

FIG. 7 is a cross-sectional view of scrubbing brush 502 sectioned along the plane E-E from FIG. 6B. The cross-sectional view of scrubbing brush 502 depicts the U-Shape of sleeve 508. Length 702 may measure 14.6 mm. In another example, length 702 may measure between 12 and 17 mm. Length 704 may measure 7.5 mm. In another example, length 704 may measure between 5 and 10 mm. Length 706 may measure 4.1 mm. In another example, length 706 may measure between 3 and 6 mm. Length 708 may measure 8 mm. In another example, length 708 may measure between 6 and 10 mm. Length 710 may measure 13.4 mm. In another example, length 710 may measure between 12 and 16 mm.

Length 712 may measure 2.3 mm. In another example, length 712 may measure between 1.8 and 2.8 mm. Length 714 may measure 2.5 mm. In another example, length 714 may measure between 2 and 3 mm.

Figure 8:
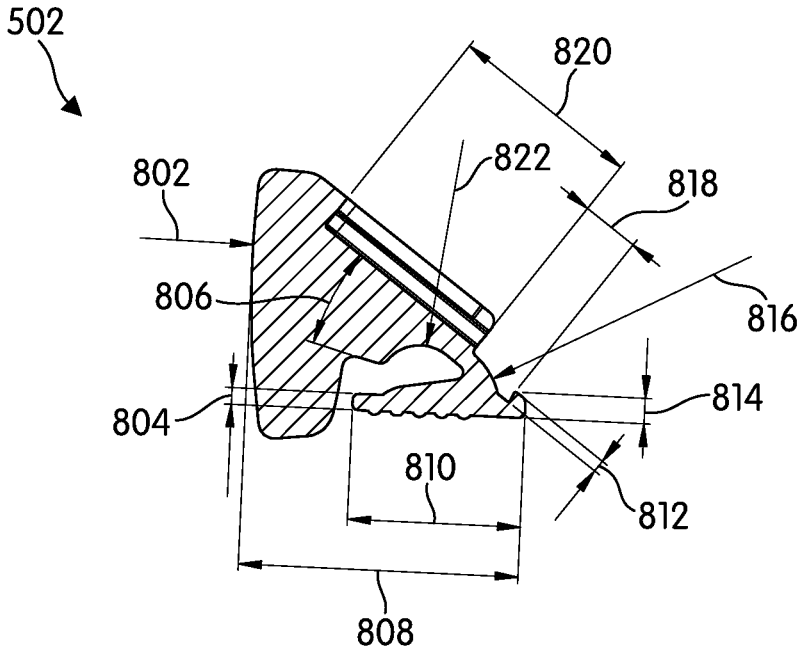
FIG. 8 is a cross-sectional view of a scrubbing brush sectioned along the plane F-F from FIG. 6C, according to one or more aspects described herein.

FIG. 8 is a cross-sectional view of scrubbing brush 502 sectioned along the plane F-F from FIG. 6C. Radius of curvature 802 may have a value of 132 mm. In another example, radius of curvature 802 may measure between 110 and 150 mm. Length 804 may measure 2.2 mm. In another example, length 804 may measure between 1.8 and 2.6 mm. Angle 806 may measure 21°. In another example, angle 806 may measure between 15 and 27°. Length 808 may measure 36.9 mm. In another example, length 808 may measure between 30 and 42 mm. Length 810 may measure 22.8 mm. In another example, length 810 may measure between 18 and 26 mm. Length 812 may measure 1.7 mm. In another example, length 812 may measure between 1.2 and 2.2 mm. Length 814 may measure 3.3 mm. In another example, length 814 may measure between 2.5 and 4.1 mm. Radius of curvature 816 may have a value of 9.9 mm. In another example, radius of curvature 816 may measure between 8.5 and 11.4 mm. Length 818 may measure 7.7 mm. In another example, length 818 may measure between 7 and 8.4 mm. Length 820 may measure 25.6 mm. In another example, length 820 may measure between 20 and 30 mm. Radius of curvature 822 may have a value of 5.5 mm. In another example, radius of curvature 822 may measure between 5 and 6 mm.

In one aspect, this disclosure includes a cleaning implement that has an elongate member with a first end and a second end spaced apart along a vertical axis. The cleaning implement may additionally include a connection assembly that is configured to be mounted on the second end of the elongate member, and configured to secure a plurality of mop fibers to the elongate member. The cleaning implement may also include a wringer that is configured to be slidably positioned along at least a portion of the elongate member. The wringer may have an upper end and a lower end, with the lower end having multiple convex regions that extend around a lower perimeter. The wringer may also have an attachment structure that is rigidly coupled to a selected one of the multiple convex regions, with the attachment structure configured to removably couple a scrubbing brush to the wringer.

In one example, the attachment structure of the cleaning implement includes a slide rail, with the slide rail having a linear portion and a ramp portion.

In another example, the scrubbing brush may have an attachment structure that includes a linear sleeve configured to receive the linear portion of the slide rail of the attachment structure of the wringer. The attachment structure of the scrubbing brush may also include a catch structure that is configured to engage with and removably coupled with a depression formed in the ramp portion of the slide rail.

The linear portion of the slide rail may have a substantially T-shaped cross-section, and the linear sleeve may have a substantially U-shaped cross-section configured to receive the slide rail.

The catch structure may include a manually actuated flexure.

The scrubbing brush may have a base structure to which a plurality of bristles are attached, and said base structure may have a substantially elliptical perimeter geometry.

The upper portion of the wringer may include multiple graspable extrusions.

The multiple convex regions of the wringer may include multiple drainage exits that are spaced apart along the vertical axis of the cleaning implement.

The cleaning implement may also include a handgrip that is coupled to the elongate member, such that the handgrip is configured to hold the wringer cup above the mop fibers when the mop fibers are being used.

In another aspect, a wringer includes an upper end and a lower end, with the lower end having multiple convex regions that extend around a lower perimeter. The wringer may additionally include an attachment structure, with the attachment structure configured to be removably coupled to a scrubbing brush.

The attachment structure of the wringer may additionally include a slide rail that has a linear portion and a ramp portion.

The scrubbing brush may also include an attachment structure that has a linear sleeve configured to receive the linear portion of the slide rail. The attachment structure of the scrubbing brush may also include a catch structure that is configured to engage and removably coupled to a depression formed in the ramp portion of the slide rail.

The linear portion of the slide rail may have a substantially T-shaped cross-section, and the linear sleeve may have a substantially U-shaped cross-section configured to receive the slide rail.

The catch structure may include a manually actuated flexure.

The scrubbing brush may include a base structure to which multiple bristles are coupled. Further, the base structure may have a substantially elliptical perimeter geometry.

An upper portion of the wringer may have multiple graspable extrusions providing a graspable surface.

The multiple convex regions of the wringer may have multiple drainage exits spaced apart along a vertical axis of the wringer.

A cleaning implement may include an elongate member having a first end and a second end along a vertical axis, and a connection assembly configured to be mounted on the second end of the elongate member and to secure multiple mop fibers to the elongate member. The cleaning implement may also include a wringer that is configured to be slidably positioned along at least a portion of the elongate member. The wringer may have a sheath structure and an attachment structure that is rigidly coupled to an outer sidewall of the sheath structure. The attachment structure may be configured to removably couple the wringer to a scrubbing brush.

The attachment structure of the cleaning implement may also include a slide rail that has a linear portion a ramp portion.

The scrubbing brush may include an attachment structure that has a linear sleeve configured to receive the linear portion of the slide rail. The attachment structure of the scrubbing brush may also include a catch structure that is configured to engage and removably coupled to a depression formed in the ramp portion of the slide rail.

This detailed description has been given for clearness of understanding only. Modifications may be obvious to those skilled in the art. The intended scope of the invention is set forth in the following claims.

We claim:

1. A cleaning implement comprising:

an elongate member having a first end and a second end along a vertical axis;

a connection assembly configured to be mounted on the second end of the elongate member and secure a plurality of mop fibers to the elongate member;

a wringer configured to be slidably positioned along at least a portion of the elongate member, further comprising:

an upper end;

a lower end, comprising a plurality of convex regions extending around a lower perimeter; and a first attachment structure, rigidly coupled to a selected one of the plurality of convex regions, the first attachment structure configured to removably couple a scrubbing brush to the wringer, wherein the first attachment structure comprises a slide rail, the slide rail comprising a linear portion and a ramp portion; and wherein the scrubbing brush further comprises a second attachment structure, the second attachment structure comprising a linear sleeve configured to receive the linear portion of the slide rail, and a catch structure configured to engage and removably couple to a depression formed in the ramp portion of the slide rail.

2. The cleaning implement of claim 1, wherein the linear portion of the slide rail has a substantially T-shaped cross-section, and the linear sleeve as a substantially U-shaped cross-section configured to receive the slide rail.

3. The cleaning implement of claim 1, wherein the catch structure comprises a manually actuated flexure.

4. The cleaning implement of claim 1, wherein the scrubbing brush comprises a base structure to which a plurality of bristles are coupled, wherein the base structure has a substantially elliptical perimeter geometry.

5. The cleaning implement of claim 1, wherein an upper portion of the wringer comprises a plurality of graspable extrusions.

6. The cleaning implement of claim 1, wherein the plurality of convex regions comprise a plurality of drainage exits spaced apart along the vertical axis of the cleaning implement.

7. The cleaning implement of claim 1, wherein the cleaning implement further comprises a hand grip coupled to the elongate member, and configured to hold the wringer above the plurality of mop fibers when the plurality of mop fibers are being used.

8. A wringer, comprising:

an upper end;

a lower end, comprising a plurality of convex regions extending around a lower perimeter; and a first attachment structure, rigidly coupled to a selected one of the plurality of convex regions, the first attachment structure configured to removably couple a scrubbing brush to the wringer, wherein the first attachment structure comprises a slide rail, the slide rail comprising a linear portion and a ramp portion; and wherein the scrubbing brush comprises a second attachment structure, the second attachment structure comprising a linear sleeve configured to receive the linear portion of the slide rail, and a catch structure configured to engage and removably couple to a depression formed in the ramp portion of the slide rail.

9. The wringer of claim 8, wherein the linear portion of the slide rail has a substantially T-shaped cross-section, and the linear sleeve as a substantially U-shaped cross-section configured to receive the slide rail.

10. The wringer of claim 8, wherein the catch structure comprises a manually actuated flexure.

11. The wringer of claim 8, wherein the scrubbing brush comprises a base structure to which a plurality of bristles are coupled, wherein the base structure has a substantially elliptical perimeter geometry.

12. The wringer of claim 8, wherein an upper portion comprises a plurality of graspable extrusions.

13. The wringer of claim 8, wherein the plurality of convex regions comprise a plurality of drainage exits spaced apart along a vertical axis of the wringer.

14. A cleaning implement comprising:

an elongate member having a first end and a second end along a vertical axis;

a connection assembly configured to be mounted on the second end of the elongate member and secure a plurality of mop fibers to the elongate member;

a wringer configured to be slidably positioned along at least a portion of the elongate member, further comprising:

a sheath structure; and a first attachment structure, rigidly coupled to an outer sidewall of the sheath structure, the first attachment structure configured to removably couple a scrubbing brush to the wringer, wherein the first attachment structure comprises a slide rail, the slide rail comprising a linear portion and a ramp portion; and wherein the scrubbing brush comprises a second attachment structure, the second attachment structure comprising a linear sleeve configured to receive the linear portion of the slide rail, and a catch structure configured to engage and removably couple to a depression formed in the ramp portion of the slide rail.

15. The cleaning implement of claim 14, wherein the linear portion of the slide rail has a substantially T-shaped cross-section, and the linear sleeve as a substantially U-shaped cross-section configured to receive the slide rail.

16. The cleaning implement of claim 14, wherein the catch structure comprises a manually actuated flexure.

17. The cleaning implement of claim 14, wherein the scrubbing brush comprises a base structure to which a plurality of bristles are coupled, wherein the base structure has a substantially elliptical perimeter geometry.

18. The cleaning implement of claim 14, wherein an upper portion of the wringer comprises a plurality of graspable extrusions.

19. The cleaning implement of claim 14, wherein the slide rail is offset from the outer sidewall of the wringer by a longitudinal spine element.

20. The cleaning implement of claim 14, wherein the linear portion of the slide rail includes a substantially planar top surface.

* * * * *